United States Patent [19]

Flentge

[11] 4,205,291

[45] May 27, 1980

[54] HEAVY DUTY CONVERTER

[75] Inventor: Robert W. Flentge, Roselle, Ill.

[73] Assignee: A. F. Dormeyer Manufacturing Co., Inc., Chicago, Ill.

[21] Appl. No.: 877,329

[22] Filed: Feb. 13, 1978

Related U.S. Application Data

[63] Continuation-in-part of Ser. No. 777,081, Mar. 14, 1977, abandoned.

[51] Int. Cl.[2] ..... H01F 27/02; H01F 15/10

[52] U.S. Cl. ..... 336/92; 336/107; 336/192; 336/198

[58] Field of Search ..... 336/192, 208, 198, 92, 336/96, 105, 107; 339/196 R; 320/2; 363/146

[56] References Cited

U.S. PATENT DOCUMENTS

| | | | |
|---|---|---|---|
| Re. 28,499 | 7/1975 | Flentge | 336/92 X |
| 1,614,309 | 1/1927 | Gaurear | 336/92 X |
| 1,741,265 | 12/1929 | Wappler | 336/92 |
| 1,968,361 | 7/1934 | Tyler | 336/92 |
| 2,583,353 | 1/1952 | Bishofberger | 336/92 X |
| 3,237,079 | 2/1966 | Mos | 336/107 X |
| 3,371,302 | 2/1968 | Mos | 336/92 |
| 3,387,244 | 6/1968 | Davis | 336/92 |
| 3,391,384 | 7/1968 | Hughes | 339/196 R |
| 3,403,366 | 9/1968 | Klatte et al. | 336/92 |
| 3,939,362 | 2/1976 | Grimes et al. | 336/192 |
| 4,028,654 | 6/1977 | Bullard et al. | 336/92 |
| 4,107,636 | 8/1978 | DiGirolamo | 336/192 XR |

*Primary Examiner*—Thomas J. Kozma
*Attorney, Agent, or Firm*—Lloyd L. Zickert

[57] ABSTRACT

A heavy duty converter including case and cover elements defining a case and cover assembly and a transformer subassembly with or without rectification within the case and cover assembly wherein flange and pin means are provided on the case and cover elements for coacting with the transformer subassembly to resiliently support the subassembly and to maintain the transformer subassembly in spaced relation to the walls of the case and cover assembly such that the hot spots of the transformer subassembly are so located as to allow efficient dissipation of the heat. Where plug-in terminals are provided for input to the power pack, the terminals are secured in place to the cover of the case and cover assembly. Various output rated transformer subassemblies may be used in the same case and cover assembly wherein the bobbin for each given size of transformer subassembly will include identical outer flanges for coaction with the flanges and pins on the case and cover assembly.

18 Claims, 20 Drawing Figures

FIG. 2
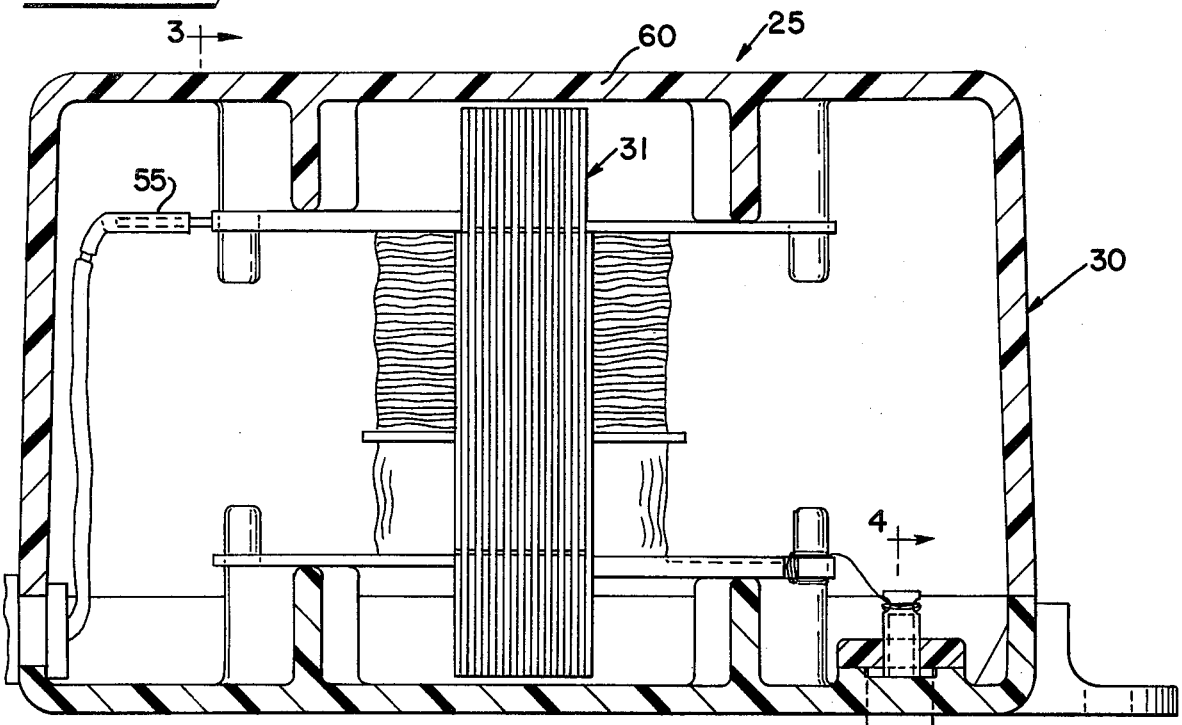
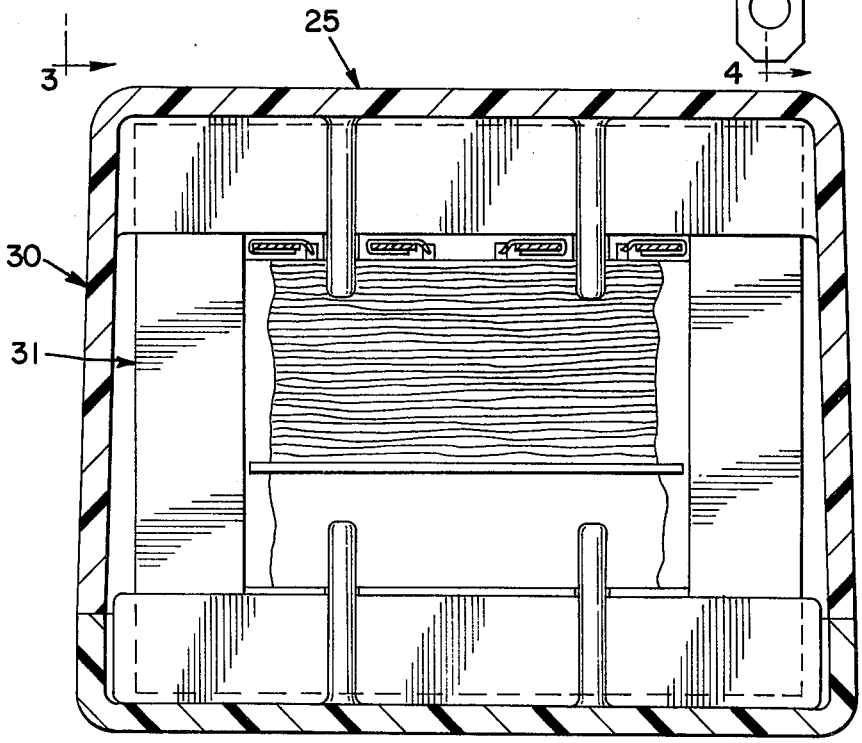
FIG. 3

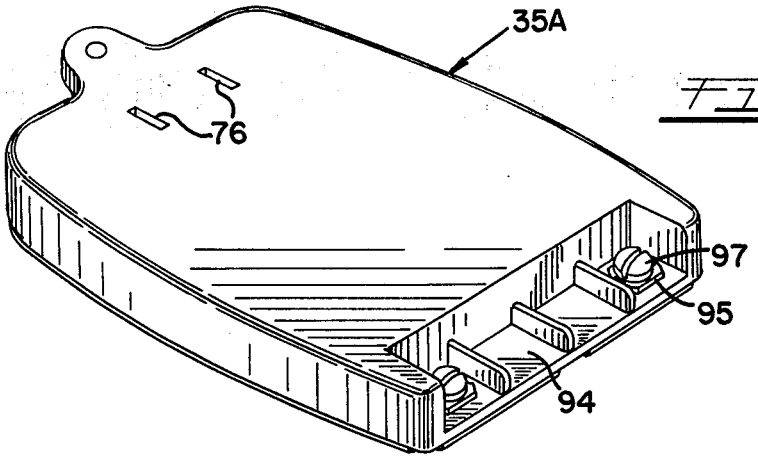
FIG. 18
FIG. 19
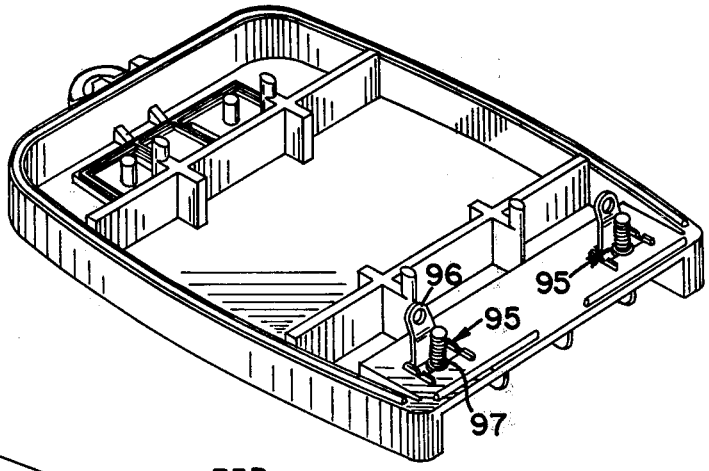
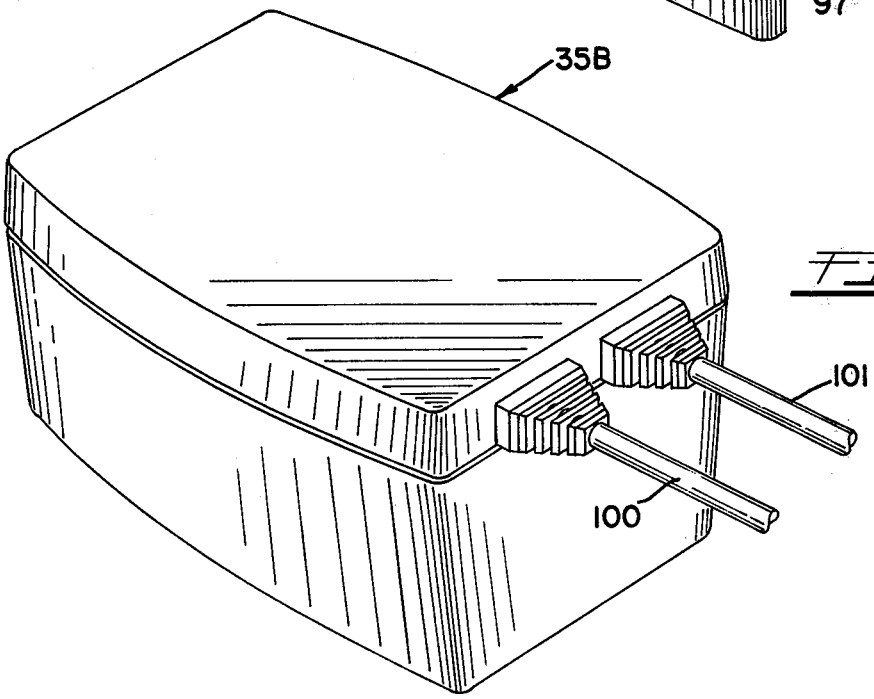
FIG. 20

HEAVY DUTY CONVERTER

This application is a continuation-in-part of my application Ser. No. 777,081, filed Mar. 14, 1977, now abandoned.

This invention relates in general to a heavy duty converter for use with large or heavy duty electrical devices to reduce line voltage and provide a low operating voltage to a device, and more particularly, to a heavy duty converter capable of providing relatively high output power.

Heretofore, many different forms of power packs or converters have been known for use with small electrical devices. For example, many converters have been used for converting line voltage to a low operating voltage for operating hand-held calculators of the solid state type, as well as other solid state devices, such as radios. Generally, the line voltage is an alternating current voltage which would be suitably converted to a direct current voltage when the converter is designed to operate a solid state device or to charge a battery. These converters also function at times for charging batteries in an appliance that is otherwise completely portable and operable independent of a line voltage. Such a converter/charger is shown in my reissue patent 28,499 granted July 29, 1975. This type of charger is limited to total weight of about eight ounces. However, these converter/chargers have been limited as to output and weight since difficulties are encountered where greater power outputs are desired because of the heat and weight problems associated with larger units. Dissipation of heat and handling of the heavier weight encountered are extremely important inasmuch as it is nearly always necessary to have Underwriters Laboratories (UL) approval for such a converter/charger before it can be used or sold, and it has not been heretofore possible to obtain UL approval of such devices capable of operating heavy duty devices. It is to be understood the term "converter" as used herein and as accepted by the industry applies to a unit used to directly power a device or charge a battery in or out of a device, and which merely reduces AC line voltage or reduces AC line voltage and rectifies the reduced voltage to provide a DC voltage output. Further, solid state circuits can be included in a case and cover assembly.

The present invention overcomes the heretofore known problems for heavy duty converters in providing a case and cover assembly of unique construction for receiving and resiliently locking in position transformer subassemblies of various outputs and weights. Weights of heavy duty converters will go up to about twenty-four ounces. The case and cover assembly for the heavy duty converter of the present invention includes case and cover elements defining a case and cover assembly. Each of the elements has flanged supports or projections and locating pins coacting with the bobbin of the transformer subassembly for shock absorbingly and resiliently supporting and locating or orienting the transformer subassembly within the case and cover assembly and in spaced relation to the walls of the case and cover elements so that the hot spots of the transformer subassembly are positioned away from the walls of the case and cover elements and so the frame of the transformer subassembly is in spaced relation with respect to the walls of the case and cover elements. The transformer subassembly includes a plastic bobbin molded of suitable electrical insulating material having outer winding flanges coacting with the support flanges and locating pins of the case and cover elements. The windings between the outer winding flanges produce an outwardly directed force on the flanges, thereby slightly spreading the flanges. The fit between the flanges of the bobbin and the support flanges of the case and cover elements is such that the bobbin flanges are under pressure to provide a spring support of the transformer subassembly. Thus, the transformer subassembly is resiliently supported within the case and cover assembly by the bobbin which also thermally insulates the windings and frame from the case and cover assembly.

While many types of input and output structures may be used depending upon the desires of the installation in which the converter is employed, where the input is structured so that it includes plug-in type terminals or prongs for engaging in a conventional electrical outlet connected to line voltage, the manner in which the terminals are held by the case and cover assembly is unique. It will be appreciated that the heavy duty converter of the present invention would be of substantial weight and therefore in order to pass UL it must be capable of operating without exposing a user to shock hazard following the standing of a drop test where the unit is dropped three feet to a hard surface. More specifically, the terminals are secured to the cover of the case and cover assembly whereby they may be connected to the transformer subassembly through flexible conductors and dropping of the converter onto a hard surface will restrict movement of the terminals and not affect disconnection between the terminals and the transformer subassembly. Heretofore, the terminals have been connected directly to the transformer subassembly, in which case dropping of the converter can cause separation of the terminals from the transformer subassembly and ultimately malfunctioning of the converter.

The heavy duty converter of the invention, when utilizing plug-in type terminals for the input, may be easily assembled by first assembling the plug-in terminals with the cover. During assembly, the cover is horizontally supported on a jig with the inside surface upward. The terminals are inserted into place on the cover where guide pins are provided for guiding the terminals into location and the prongs are insertable into the openings in the cover top wall. A retaining plate is applied over the terminals on the inside of the cover and sonic welded or cemented into place to lock the terminals to the cover. Thereafter, the transformer subassembly is positioned onto the cover. The windings are then connected to input and output connectors. Where soldering procedures are employed, it can be appreciated that everything is open around the transformer subassembly to facilitate access to the winding leads and/or terminals. The case is mounted in place, it being appreciated that the outer flanges on the bobbin in the transformer subassembly coact with flanges and pins on the case and cover to properly position the transformer subassembly within the case and cover assembly. Finally, the case and cover are sonically welded or cemented together to complete the assembly of the converter.

It is therefore an object of the present invention to provide a uniquely structured, new and improved heavy duty converter for converting line voltage to a reduced voltage for operating relatively large or heavy duty electrical devices.

Another object of the invention resides in the provision of a heavy duty converter having a unique suspension system for the transformer subassembly whereby the subassembly can absorb the shock of dropping the converter to a hard surface, and more particularly, because the subassembly is shock absorbingly mounted within the case and cover assembly of the converter.

A further object of the present invention is in the provision of a heavy duty converter having input plug-in terminals secured to the cover of a case and cover assembly of the converter wherein the converter can withstand a drop test and maintain connection between the terminals and the transformer subassembly.

A still further feature of the present invention is in the provision of a heavy duty converter having a transformer subassembly oriented and locked in position within the case and cover assembly so that the hot spots of the transformer subassembly are spaced from the case and cover panels so that heat produced by the subassembly can be efficiently dissipated, thereby permitting a greater power output for the unit.

Another object of the invention is to provide a heavy duty converter having a case and cover assembly and a transformer subassembly having a bobbin with outer winding flanges having means coacting with supporting and locating means in the case and cover assembly to thermally insulate the windings and frame of the subassembly from the case and cover assembly and to space the frame from the walls of the case and cover assembly.

Another object of this invention is in the provision of a method of making a heavy duty converter which includes securing input plug-in type terminals to the cover, positioning the transformer subassembly on the cover and soldering the conductors from the subassembly to input and output terminals, and securing the case in position by sonic welding the case and cover together.

Other objects, features and advantages of the invention will be apparent from the following detailed disclosure, taken in conjunction with the accompanying sheets of drawings, wherein like reference numerals refer to like parts, in which:

FIG. 2 is a vertical sectional view of the converter in FIG. 1 taken substantially along line 2—2 of FIG. 1;

FIG. 3 is a vertical sectional view of the embodiment of FIG. 1 and taken substantially along line 3—3 of FIG. 2;

FIG. 13 shows the positioning of the cover on a jig with the inside surface facing outwardly and the blade terminals in place;

FIG. 14 shows the terminal locking bar mounted in place and sonic welded or cemented to the cover;

FIG. 15 illustrates the positioning of the transformer subassembly onto the cover and terminal subassembly;

FIG. 16 illustrates the step of connecting the primary terminals to the primary winding and the secondary winding to the output terminals;

FIG. 17 illustrates a further step in the mounting of the case onto the cover and thereafter sonic welding or cementing the case and cover together;

FIG. 18 is a perspective view of a modified cover looking at the outside of the cover and illustrating a screw terminal type output;

FIG. 19 is a perspective view of the cover of FIG. 18 but looking at the inside surface of the cover; and FIG. 20 is a perspective view of another form of converter differing in that it is provided with a line-to-line input-output connection.

Figure 1:
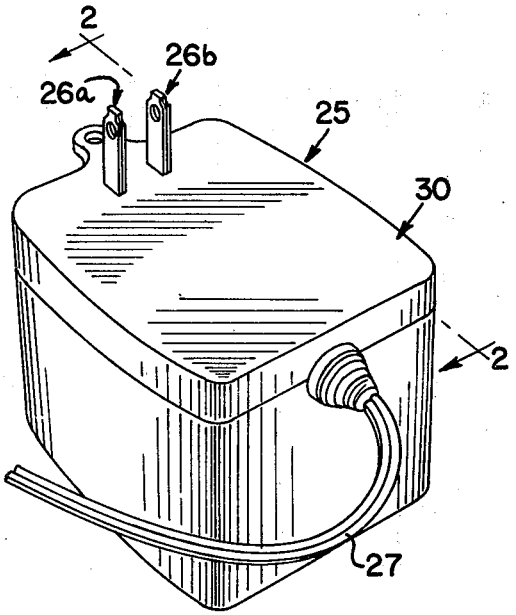
FIG. 1 is a perspective view of one form of heavy duty converter according to the present invention and showing the side of the converter which includes the plug-in type terminals for connecting the converter to an electrical outlet.
Figure 7:
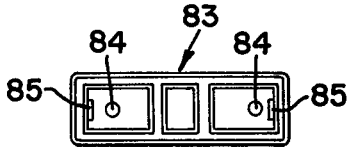
FIG. 7 is a plan view of the retaining plate or locking bar or plate for the primary terminals and looking at the side that faces the cover and terminals when the locking bar is assembled with the cover.

Referring now to the drawings, and particularly to the embodiment shown in FIGS. 1 to 12, a heavy duty converter 25 is shown which includes a connection for the input in the form of a pair of blade or primary terminals *26a, 26b* for engagement in a conventional electrical wall plug connected to line voltage and a connection for the output in the form of a line cord 27 which may have any suitable connector on its end for interconnection with an appliance or device which receives the output of the converter. The blade terminals are also sometimes called prongs. A cord fitting 28 is provided on the line cord for mounting the cord in the case and cover assembly. It will be appreciated that the converter may be of the type which merely reduces the line voltage connected to the input or otherwise changes the line voltage to a suitable operating voltage. For example, where the line voltage is 115 volts AC 60 Hz, it may be reduced to 15 volts AC 60 Hz. Alternately, the output voltage may be rectified by means of suitable rectifying devices to produce a direct current or otherwise conditioned to change the frequency. One or more outputs may be provided from the converter as desired. Further, it should be appreciated that the converter may even have an input structure different from that shown in the embodiment of FIG. 1, such as that shown in the embodiment of FIG. 20. It should also be recognized that the converter may serve as a battery charger if so desired.

The converter 25 includes in general a case and cover assembly 30 and a transformer subassembly 31 mounted within the case and cover assembly. One of the features of the present invention which will be more apparent following the specific description of the transformer subassembly 31 is in the ability of the converter to have various power output ratings by changing the structure of the transformer subassembly without necessitating a change in the structure or sizing of the case and cover assembly.

Figure 6:
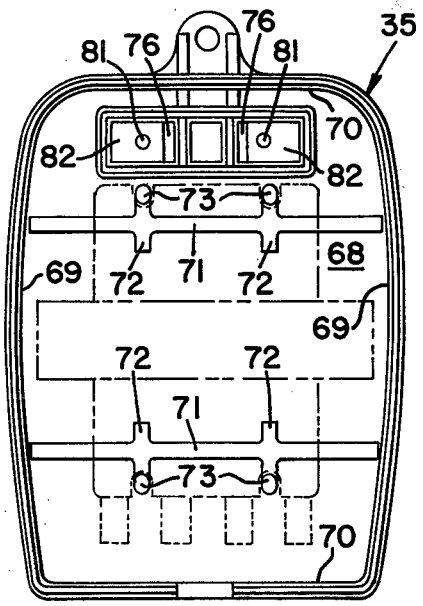
FIG. 6 is an inside plan view of the cover.
Figure 5:
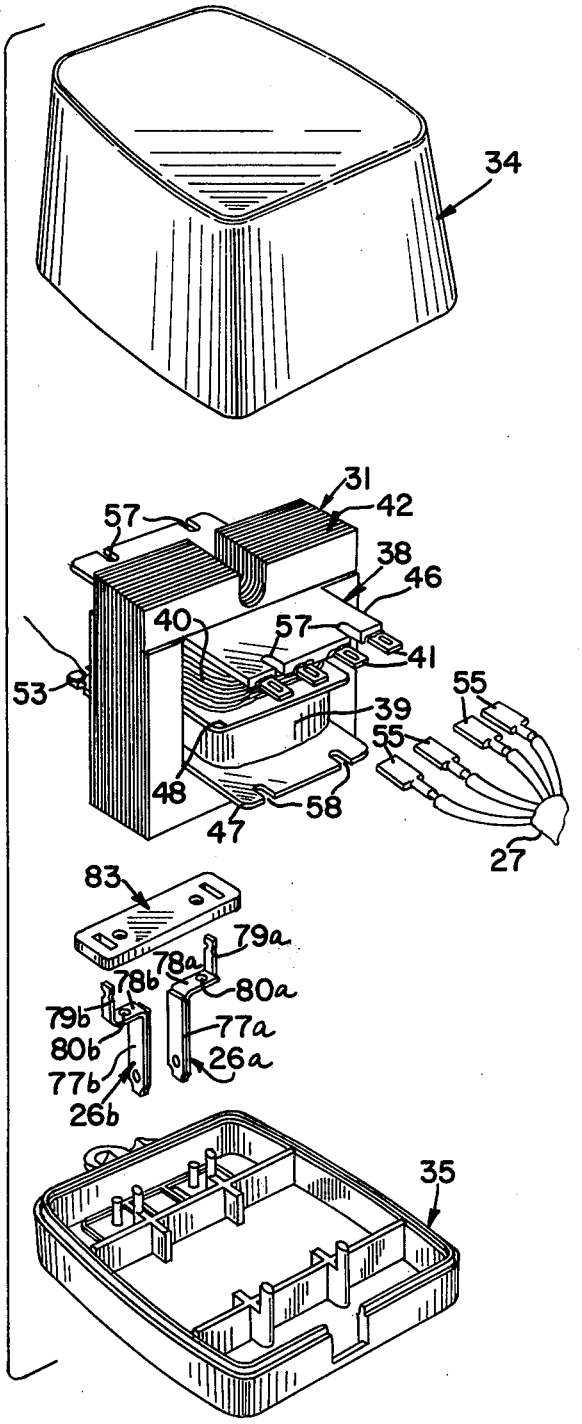
FIG. 5 is an exploded perspective view of the embodiment of FIG. 1.
Figure 9:
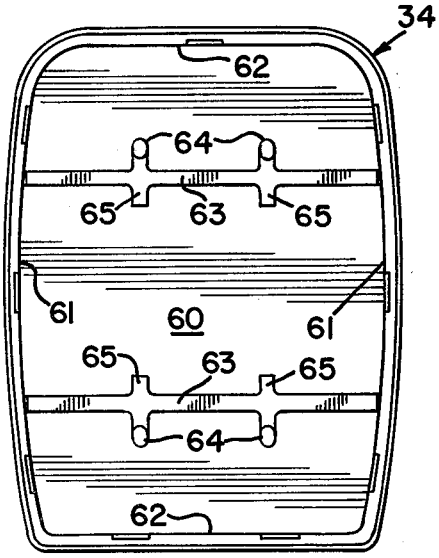
FIG. 9 is an inside plan view of the case and cover assembly.

The case and cover assembly 30 includes generally a case 34 and a cover 35. The case and cover are shown in the exploded view of FIG. 5, while the case is shown in FIG. 9 and the cover is shown in FIG. 6. In the final assembly of the converter, the case and cover are welded, cemented, or otherwise secured together. Preferably, ultrasonic welding, commonly referred to as "sonic welding," is employed.

The transformer subassembly 31 includes generally a bobbin 38 of molded high strength, electrically insulating plastic material such as a glass filled polyester, nylon or a compression molded phenolic, primary and secondary windings 39 and 40 respectively on the bobbin, a plurality of secondary lugs 41 secured to the bobbin for interconnecting the secondary winding and the output connections to the converter, and an iron core or frame 42 of laminated structure having portions surrounding the bobbin and windings along one axis together with a portion extending through the center of the bobbin and windings for the purpose of magnetically coupling the primary and secondary windings. Magnet wire for the windings would be copper with a suitable electrical insulating coating. Other than the supporting structure of the bobbin, and particularly the structure of the outer winding flanges, the transformer subassembly 31 is of a type heretofore known and heretofore utilized in converters. The magnet wire would be wound on the bobbin such that the windings would cause some spreading of the winding flanges.

Figure 10:
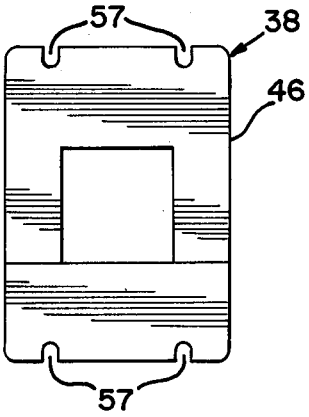
FIG. 10 is a top plan view of the bobbin used with the transformer assembly to illustrate the construction of an outer winding flange.
Figure 11:
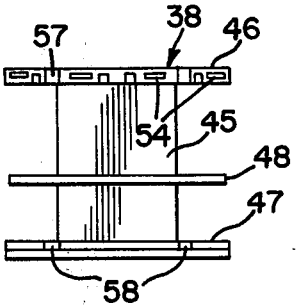
FIG. 11 is an end elevational view of the bobbin of FIG. 10 and looking at the end which may receive a series of lugs to provide connections between the secondary winding and the input cord or terminals.
Figure 12:
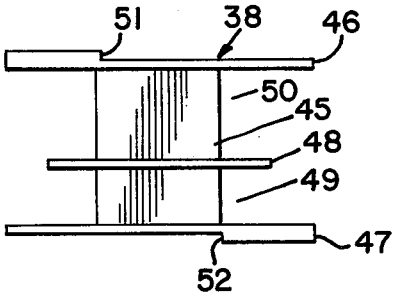
FIG. 12 is a side elevational view of the bobbin of FIG. 10.

The molded plastic bobbin 38 is shown by itself in FIGS. 10, 11 and 12 and includes a hollow body 45, first and second outer winding flanges 46 and 47, and an intermediate winding flange 48. While the hollow body 45 is shown to be rectangular in cross section, it may be appreciated it could be circular in cross section or otherwise formed if so desired. Further, the winding flanges 46, 47 and 48, while shown to be rectangular, may also be circular or otherwise formed. The winding flanges are parallel to each other and extend perpendicular to the long axis of the hollow body 45. A first winding area 49 is defined between the winding flanges 47 and 48 and in which the primary winding 39 is located, while a second winding area 50 is defined between the outer winding flange 46 and the intermediate winding flange 48 for receiving the secondary winding 40. It should be appreciated the intermediate winding flange may be eliminated where the first and secondary windings are wound one on top of the other in a manner well known.

The outer winding flange 46 is heavier in thickness at one end and defines a shoulder 51 against which the laminated iron core 42 will abut. Similarly, the outer winding flange 47 is of a greater thickness at one end opposite to the thicker end of the winding flange 46 and defines a shoulder 52 against which the iron core 42 abuts. Accordingly, when the iron core is assembled in relation to the bobbin following the application of the primary and secondary windings, it is locked in place by the shoulders 51 and 52 in addition to the central portion of the core which extends through the hollow body 45. It should be appreciated the shoulders on the outer winding flanges could be omitted as the iron core with its central leg extending through the bobbin will be thereby held in place.

The outer flanges 46 and 47 of the bobbin are constructed at one end of a thicker section for further purposes of handling the leads coming from the windings. The outer winding flange 47 on the side of the primary winding 39 is notched to facilitate handling of the leads wherein a portion is wound around, as shown at 53 in FIG. 5. From that point the leads can be connected to the input structure of the converter, and in the embodiment of FIGS. 1 to 12, they would be connected to the blade terminals 26. The thickened portion of the outer winding flange 46 includes a plurality of sockets 54 which receive the secondary lugs 41. The leads from the secondary coil 40 are first connected to the secondary lugs 41 and thereafter connected to the output structure of the converter. As particularly shown in FIGS. 2 and 5, quick release connectors 55 connected to the ends of the conductors of line cord 27 provide the interconnection between the secondary lugs 41 on the bobbin and the output line cord. As will be apparent hereafter, the secondary lugs 41 may be connected to screw terminals if so desired. The leads from the secondary cord could be directly connected to the output line or screw terminals whereby the secondary lugs could be eliminated.

In order to lock and precisely position the transformer subassembly 31 within the case and cover assembly 30, notches are provided on the outer winding flanges of the bobbin for receiving locking pins which will be hereinafter described and which are formed on the case and cover. More specifically, locating notches 57 are provided on the opposite ends of the winding flange 46, while locating notches 58 are provided on the opposite ends of the winding flange 47.

It has been heretofore stated that the transformer subassembly may have various power ratings and may provide various output voltages. The embodiment shown in FIGS. 1 to 12, where four secondary terminals are provided on the bobbin, is intended to provide two different voltage outputs from the secondary winding 40. It can be appreciated that any number of voltage outputs may be provided as desired. It further may be appreciated that the windings on the bobbin may vary as to the size of the wire and the amount of the wire to obtain a desired output. Further, the amount of the wire as well as the size of the laminated core 42 may be varied to provide the desired power output. The width of the iron core 42 may vary depending upon the output power rating, and in this instance, there would only need to be a change in the dimensions of the hollow body of the bobbin. The dimensions of the outer winding flanges relative to spacing the locating notches in the same place would always be the same so that transformer subassemblies of various power ratings could be used with the same size case and cover assembly.

The case 34 of the case and cover assembly 30 is somewhat rectangular in cross section and includes a bottom or base wall or panel 60, opposed side walls 61 and opposed end walls 62 which coact to define a cavity or compartment within which the transformer subassembly 31 is received. Means are provided at the base or bottom wall or panel 60 for spacing the transformer subassembly from the walls of the case and locking the subassembly against movement relative to the case. This means includes a pair of upstanding supporting flanges 63 integrally formed with the panel 60 and the side walls 61 and locating pins 64 which coact with notches 57 of the outer bobbin winding flange 46. The two supporting flanges 63 are parallel to each other and extend vertically with respect to the base panel 60. The sides of the flanges at the base panel 60 are integrally formed therewith, while the opposite ends of the flanges are integrally formed with the side walls 61. One of the flanges is of a greater height than the other flange as one flange engages the thicker end of the bobbin outer winding flange 46, while the other of the supporting flanges engages the thinner portion of the bobbin winding flange, as seen most clearly in FIG. 2. Accordingly, the plane of the winding flange 46 will parallel the bottom or base wall or panel 60.

Each supporting flange 63 has integrally formed with it and the base panel 60 a pair of spaced apart perpendicularly extending supporting flanges or crossbars 65 extending perpendicular to the base panel 60 and perpendicular to the supporting flange and defining an upper supporting surface for the bobbin winding flange which is contiguous with the supporting surface of the supporting flange 63. The locating pins 64 are formed integrally with the crossbars 65 at one end thereof and adjacent to the side walls. Accordingly, the outer winding flange 46 abuts against the supporting flange 63 and the crossbars 65. The locating pins 64 are spaced apart such as to mate with the locating notches 57 of the winding flange 46, as seen in FIGS. 2 and 3. Accordingly, it will be appreciated that once the transformer subassembly is in seated engagement with the supporting flanges 63 and crossbars 65 and the locating pins 64 mate with the locating notches 57, the end of the transformer subassembly at the outer winding flange 46 is locked against movement relative the case 34. More specifically, the supporting flanges 63 and crossbars 65 prevent movement of the transformer subassembly in a direction toward the base wall or panel 60, while the locating pins 64 prevent movement of the transformer subassembly in a direction toward either of the side or end walls.

The cover 35 is formed like the case 34 with respect to locking one end of the transformer subassembly in position within the case and cover assembly. In this respect, the cover 35 includes a top or base wall or panel 68, opposed side walls 69 and opposed end walls 70. It can be appreciated the depth of the side and end walls 69 and 70 is substantially less than the depth of the side and end walls 61 and 62 of the case 34. It will be further appreciated that the side and end walls 69 and 70 will mate with the side and end walls of the case, as seen particularly in FIGS. 2 and 3. Means are provided on the base wall or panel 68 for locating and locking the appropriate end of the transformer subassembly in place. This means is of the identical nature as that provided in the case 34 in that it includes supporting flanges or projections 71, together with perpendicularly extending supporting flanges or crossbars 72 and locating pins 73. The structure of the supporting flanges 71, crossbars 72 and locating pins 73 is identical to the structure of the like elements in the case 34. Again, one of the supporting flanges and its accompanying crossbars define a supporting surface for the outer bobbin winding flange 47 at a different level than the other supporting flange 71 and crossbar 72, as seen in FIG. 2. In this respect, the location of the higher supporting flange and crossbar arrangement is diagonally opposed to the like supporting flange and crossbar arrangement for the case so that the outer bobbin winding flange 47 will be seated in parallel relation to the base wall or panel 68, as seen in FIG. 2. The cover is notched at 74 to receive the cord fitting 28.

The engaging edges of the case and cover are formed with a suitable weld joint such that during the assembly of the case and cover, they will be precisely positioned relative each other and thereafter the joint may be subjected to a suitable welding operation such as by an ultrasonic welder to fuse the case and cover together and form essentially a tight joint or seam. It will then be appreciated that the transformer subassembly 31 is positioned and locked in place within the case and cover assembly so that it cannot shift or move relative to the case and cover assembly. Further, it can be appreciated, as seen particularly in FIGS. 2 and 3, the hot spots of the transformer subassembly essentially face the end walls of the case, and since considerable spacing is provided between those hot spots and the end walls, heat is readily dissipated and is not directed toward the top and bottom walls or panels of the case and cover. It is therefore appreciated that it is important the transformer subassembly be oriented within the case and cover assembly as illustrated in FIGS. 2 and 3. This feature allows for an increase in power output of the transformer over heretofore known converters.

The weight of a heavy duty converter of the present invention may reach twenty-four to twenty-eight ounces, which weight is difficult to control and maintain integrity should the converter be dropped or otherwise mishandled. Underwriters Laboratories (UL) tests for integrity by subjecting the converter to a drop test.

Since the portions of the input blade terminals within the case and cover assembly connected to the primary winding are not insulated, the case and cover assembly must remain intact to prevent shock hazard exposure. It is therefore necessary to shock absorbingly mount the transformer subassembly within the case and cover assembly. The unique mounting of the transformer subassembly according to the present invention accomplishes this objective.

First, application of the windings between the outer winding flanges causes slight spreading of the flanges. The dimensions of the case and cover elements, and particularly the relationship between the support flanges and the bobbin flanges cause a fit when the converter is completely assembled and the case and cover elements are welded together such that the outer bobbin flanges in engagement with the case and cover support flanges are under some pressure and the transformer subassembly, including the bobbin, windings and laminations, is resiliently supported by the case and cover assembly. As seen particularly in FIG. 2, the outer end portions of the outer bobbin flanges which extend beyond the windings engage the support flanges on the case and cover elements to effectively utilize the outer bobbin flanges and particularly the portions between the laminations and the windings as spring members in relation to the support flanges on the case and cover assembly. The windings of magnet wire function to absorb shock or dampen vibrations of the transformer subassembly which is resiliently suspended from the case and cover assembly. Accordingly, a sudden force or jolt to the converter, such as when the converter may be dropped to a hard surface, would not cause displacement of the transformer subassembly from its mounting or possible fracture of the case and cover assembly. Rather, the unique mounting arrangement and fit between the subassembly and the case and cover assembly will protect against displacement of the subassembly from the case and cover assembly inasmuch as the subassembly is resiliently mounted to the case and cover assembly and the windings dampen any vibrations. Thus, the windings have an energy or shock absorbing characteristic. It will be appreciated the material of the bobbin must have a resiliency such that it will not fracture. Although the bobbin flanges will mostly function as springs, they would be capable of absorbing some shock. Without this unique mounting arrangement, it would not be possible for the heavy duty converter to pass the UL drop test.

Figure 8:
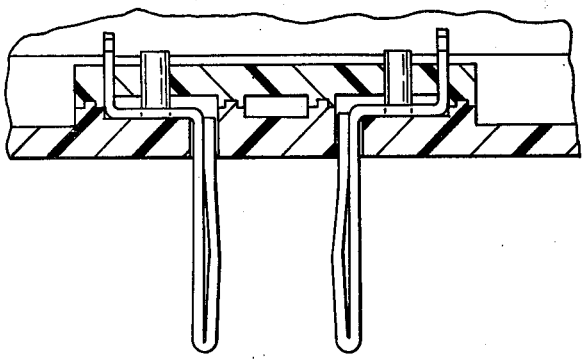
FIG. 8 is an assembly view of the cover, primary terminals and locking bar in section and like FIG. 4 except that the locking bar has not yet been sonic welded or cemented in place.
Figure 4:
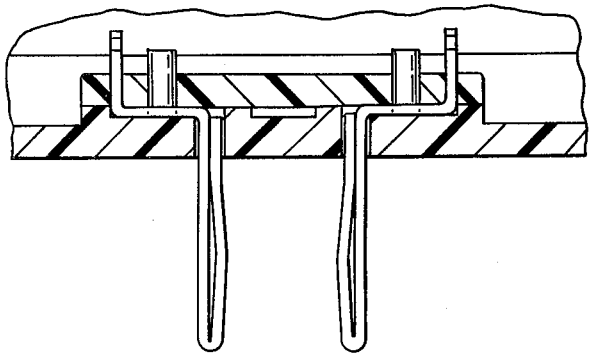
FIG. 4 is a greatly enlarged sectional view of a detail and which is taken substantially along line 4—4 of FIG. 2.

The cover 35 in the embodiment of FIGS. 1, 2 and 12, where a blade terminal input arrangement is provided, includes structure integrally formed with the top panel 68 which coacts with the blade terminals and a blade terminal locking or retaining bar to secure the blade terminals to the cover. The panel 68 includes a pair of blade terminal slots 76 through which the blade terminals 26 extend. As seen particularly in FIG. 5, the blade terminals 26 include blade portions 77, anchor portions 78 and lug portions 79. Inasmuch as the blade terminals are more specifically identified as **26*a* and 26*b*, the numerals identifying the specific portions of the blade terminals are also suffixed with the letters "a" and "b". While the blade terminals are identically formed, they are arranged in opposed relation so that the lug portions are spaced further apart than the blade portions. The lug portions and blade portions are essentially parallel to each other although offset, while the anchor portions extend substantially perpendicular to the blade and lug portions. Guide pin holes 80 are provided in the anchor portions 78 for receiving guide pins 81 formed integrally on the top panel 68. When the blade terminals are mounted on the cover, the blade portions slide through the blade slots 76 and the guide pin holes 80 receive the guide pins 81. Additionally, the anchor portions 78 are received within recesses 82 formed on the top panel 68 by a weld joint configuration which coacts with the locking bar or plate 83. The locking bar 83 retains and locks the terminal blades in place on the cover after it is positioned against the terminals and sonic welded or cemented in place. The locking bar is rectangular in shape and formed with a weld joint that mates with a weld joint on the top panel 68, as seen in FIG. 8. Further, the locking plate 83 includes guide pin holes 84 and lug portion slots 85. The guide pin holes 84 are positioned to mate with the guide pins 81 to guide the locking plate into position and the lug portion slots 85 are arranged to receive the locking lugs, as shown in FIG. 8. Following the sonic welding or cementing of the locking plate 83 to the cover, the locking plate bears directly against the anchor portions 78 of the terminal blades, as seen in FIGS. 2 and 4, to firmly lock the blade terminals 26 to the cover 35**. This feature is important inasmuch as the converter must stand a drop test to be approved by Underwriters Laboratories, and during the drop test the blade terminals cannot be broken away from the transformer subassembly as would be the case if they were mounted on the transformer subassembly.

Figure 13:
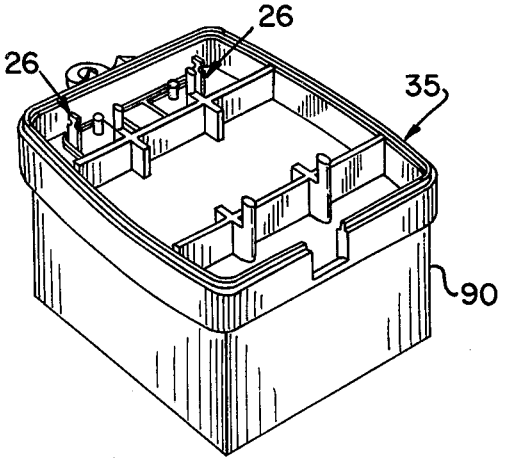
FIGS. 13 to 17 illustrate the assembly steps for making the heavy duty converter of the present invention.
Figure 14:
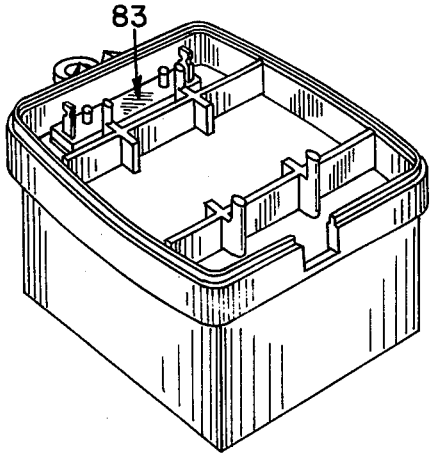
Figure 15:
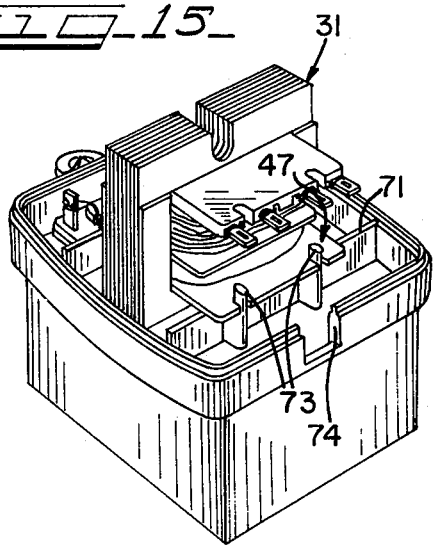
Figure 16:
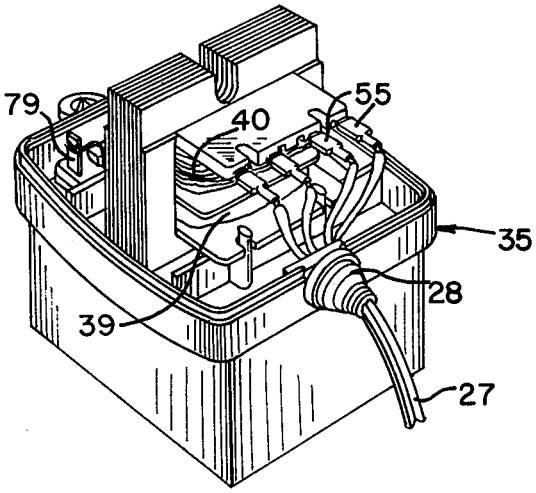
Figure 17:
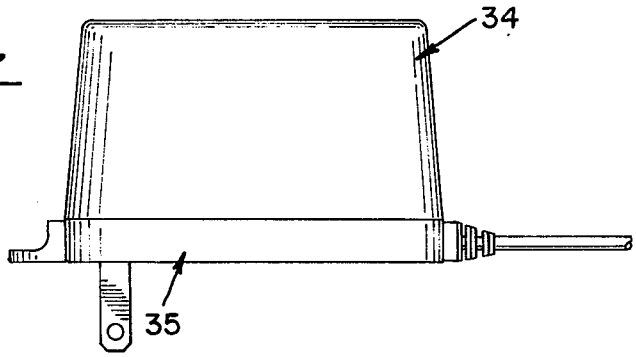

The heavy duty converter of the invention, and particularly the embodiment of FIGS. 1 to 12, is assembled in the following manner, as shown particularly in FIGS. 13 to 17. The cover 35 is first placed on a jig 90 which may be in the form of a rectangular box and which would be of such a height to allow insertion of the blade terminals 26. The cover is turned so that the interior faces upwardly, as shown in FIG. 13. The blade terminals 26 are then inserted into the cover as shown whereby the blade portions would be pushed through the blade terminal slots in the cover until the anchoring portions of the blade terminals are seated, as shown in FIG. 8. The locking bar 83 is next placed over the guide pins and lug portions of the blade terminals and thereafter sonic welded to the cover as shown in FIG. 4. The transformer subassembly 31 is seated on the cover whereby the outer winding flange 47 is seated on the cover supporting flanges 71 and crossbars 72 with the locating pin notches 58 in mating engagement with the locating pins 73. The windings are then connected to the input and output structures. The leads from the primary winding 39 are soldered to the lug portions 79 of the blade terminals and the quick release connectors 55 are slipped onto the secondary lugs 41. Alternatively, the primary winding leads could be connected to lugs mounted on the bobbin which would engage and be soldered or otherwise connected to the blade terminals. It will be appreciated the leads from the primary coil extend from the outer winding flange 47 while the leads from the secondary coil are connected to the secondary lugs on the outer winding flange 46. The cord fitting 28 of the cord 27 is then mounted in place in the notch 74 of the cover.

It will be appreciated here that any other type of connections may be made between the conductors of the line cord 27 and the secondary lugs on the bobbin. For example, the conductors may be soldered to the secondary lugs which already have soldered or cemented thereto the leads from the secondary coil 40. Thereafter, the case 34 is mounted into place on the cover 35 so that the locating pins and supporting flanges and crossbars in the case engage the other end of the bobbin, as shown in FIGS. 2 and 3. Finally, the case and cover at the seam or joint is subjected to a sonic welding or cementing operation to weld or cement the case and cover together and thereby complete the assembly of the converter. It can thereby be appreciated that the converter of the present invention may be quickly and easily assembled. Where soldering functions are necessary, the lug portions of the terminal blades and the secondary lugs are open to the operators for ease of soldering.

A modified cover is shown in FIGS. 18 and 19 and designated by the numeral 35A. This cover differs from the cover 35 of the first embodiment only in that the output of the converter is structured to be of the screw terminal type instead of the line cord type shown in FIGS. 1 to 12. The cover 35A is formed with a terminal plate 94 at the end opposite the terminal blade slots 76, wherein any number of screw terminal assemblies 95 may be mounted depending upon the number of output leads from the secondary winding of the transformer subassembly. As seen in FIG. 19, the screw terminal assemblies 95 are staked into place in openings in the terminal plate 94 and provided with lug portions 95 to which leads from the secondary winding may be connected in any suitable fashion. For example, those leads may be soldered to the lug portions. Screws 97 adjustable from the outside of the cover, as seen in FIG. 18, may be utilized in the usual fashion for connecting a conductor to the terminal assembly. It will be appreciated that the other features of the present inventon with respect to mounting the transformer subassembly within the case and cover assembly and with respect to mounting the blade terminals to the cover are identical to those described above in connection with FIGS. 1 to 12. The cover 35A as well as the cover 35 includes a mounting portion adjacent the blade terminals adapted to coact with a fastener of the electrical outlet to which the converter may be connected for further supporting the weight of the converter. Other means may be provided for supporting the weight of the converter such as a pin secured to the cover for engaging in the ground hole of a typical three-hole outlet.

A further embodiment of the invention is illustrated in FIG. 20 wherein the converter is generally designated by the numeral 35B and which differs from the above embodiments only in the manner in which the input power is connected to the primary winding of the transformer subassembly. In this embodiment, a line cord 100 is provided for the input to the converter, while a line cord 101 is provided for the output. Both line cords are mounted relative the case and cover assembly in the same manner as described in connection with the mounting of line cord 27 with the case and cover assembly illustrated in FIGS. 1 to 12. The cover of the converter 35B further differs in that it will not have mounted thereon blade terminals. However, the structure of the case and cover assembly relative to mounting of the transformer subassembly therein is identical to that shown in the embodiment of FIGS. 1 to 12. It can now be appreciated that any type of input or output connections may be provided for the converter of the present invention even though one feature of the invention is in the manner in which the terminal blades in the embodiment of FIGS. 1 to 12 and the embodiment of FIGS. 18 and 19 are mounted on the cover of the case and cover assembly.

It will be understood that modifications and variations may be effected without departing from the scope of the novel concepts of the present invention, but it is understood that this application is to be limited only by the scope of the appended claims.

The invention is hereby claimed as follows:

1. A heavy duty converter for use with electrical devices to reduce line voltage and provide a low operating voltage, said converter comprising a case and cover assembly and a transformer subassembly within the case and cover assembly, said transformer subassembly including a bobbin of electrical insulating material having a hollow body, first and second outer winding flanges extending perpendicularly to the axis of the hollow body, primary and secondary windings on the hollow body between the winding flanges, each of said flanges having an outer side remote from the windings and an inner side adjacent said windings and an iron frame surrounding said bobbin along one axis and having a leg extending through the hollow body for magnetically coupling the windings, said case and cover assembly including top, bottom side and end walls, means integrally formed with the top and bottom wall of the case and cover assembly and coacting with the outer winding flanges of the bobbin to mount the transformer subassembly within the case and cover assembly so that the frame is spaced from the walls and the subassembly is resiliently mounted to the case and cover assembly, said means being spaced outwardly of said hollow bobbin body and supporting said outer flange sides, and connector means for said windings to connect the primary winding to a voltage source and the secondary winding to an electrical device.

2. The converter defined in claim 1, wherein the means on the case and cover assembly coacting with the outer winding flanges of the bobbin to mount the transformer within the case and cover assembly further spaces the hot spots of the transformer subassembly away from the top and bottom walls.

3. The converter defined in claim 1, wherein the means on the case and cover assembly and the transformer subassembly are sized such that the fit between the bobbin flanges and the means on the case and cover assembly places the flanges under pressure and the windings, laminations and bobbin are spring supported by the case and cover assembly.

4. The converter defined in claim 1, wherein the structure of the subassembly and the mounting means therefor resiliently and shock absorbingly mounts the subassembly with respect to the case and cover assembly.

5. The converter defined in claim 1, wherein said connector means includes blade terminals connected to the primary winding and having blade portions extending through openings in the top wall for engagement in a wall outlet and lug portions connectable to the primary winding, and means for securing the terminals to the cover.

6. The converter defined in claim 5, wherein said connector means further include a line cord connected to the secondary winding and connectable to an appliance.

7. The converter defined in claim 5, wherein said connector means further include screw terminals secured to the case and cover assembly and connected to said secondary winding.

8. The converter defined in claim 1, wherein said connector means includes a line cord connected to the primary winding and a line cord connected to the secondary winding.

9. A heavy duty converter for use with an electrical device to reduce line voltage and provide a low operating voltage, said converter comprising a case and cover assembly and a transformer subassembly within the case and cover assembly, said transformer subassembly including a bobbin of electrical insulating material having a hollow body, first and second outer winding flanges extending perpendicularly to the axis of the hollow body, primary and secondary windings on the hollow body between the winding flanges, each of said flanges having an outer side remote from said windings and an inner side adjacent said windings, and an iron frame surrounding said bobbin along one axis and having a leg extending through the hollow body for magnetically coupling the windings, said case and cover assembly including a case and a cover adapted to be secured together as a final step in the assembly of the converter, said case including a bottom wall and side and end walls, first means integrally formed at the bottom wall coacting with outer end portions of one of said outer winding flanges for positioning the transformer subassembly in spaced relation to the bottom, side and end walls of the case, said first means being spaced outwardly of said bobbin hollow body and supporting said outer flange side of said one flange, said cover including a top wall and side and end walls, second means integrally formed at the top wall coacting with outer end portions of the other of said outer winding flanges for positioning the transformer subassembly in spaced relation to the top, side and end walls of the cover, said second means being spaced outwardly of said bobbin hollow body and supporting said outer flange side of the other of said flanges, and said first and second means coacting with said bobbin winding flanges and said windings to collectively shock absorbingly and resiliently mount said transformer subassembly within said case and cover assembly in a position such that heat is dissipated away from the top wall of the cover and the bottom wall of the case.

10. The converter defined in claim 9, wherein the outer end portions of the bobbin flanges coacting with said first and second means extend beyond the outer surface of the windings.

11. The converter defined in claim 9, which further includes blade terminals having blade portions extending through openings in the top wall to the outside and wire receiving lug portions on the side adjacent the transformer subassembly, and means for securing said terminals to the cover.

12. The converter defined in claim 11, wherein said first and second means includes supporting flanges in engagement with the outer winding flanges spacing the subassembly from the top wall of the cover and the bottom wall of the case.

13. The converter defined in claim 12, wherein said first and second means further includes subassembly locating means having locating pins coacting with the outer winding flanges.

14. The converter defined in claim 13, wherein said supporting flanges include flanges extending between the side walls of the case and cover and flanges extending substantially perpendicular thereto.

15. The converter defined in claim 11, wherein said means for securing said terminals to the cover includes a retaining plate welded or cemented to the cover.

16. The converter defined in claim 11, wherein said blade terminals further include anchor portions seating against and extending substantially parallel to the cover, and said means for securing said terminals to the cover abutting against said anchor portions and being welded to the cover.

17. The converter defined in claim 16, wherein said means for securing said terminals to the cover includes a retaining plate having slots through which the wire receiving lug portions extend.

18. The converter defined in claim 11, wherein said blade terminals further include anchor portions between the blade portions and the lug portions, said anchor portions extending substantially parallel to the cover and seating thereagainst, and said means for securing said terminals to the cover abutting against said anchor portions and being secured to the cover.

* * * * *